United States Patent [19]

Perchak et al.

[11] Patent Number: 4,505,404

[45] Date of Patent: Mar. 19, 1985

[54] CONTAINER WITH INTEGRAL CLOSURE

[75] Inventors: William C. Perchak, Chicago; Douglas E. Foos, Warrenville, both of Ill.

[73] Assignee: Plastofilm Industries, Inc., Wheaton, Ill.

[21] Appl. No.: 587,814

[22] Filed: Mar. 9, 1984

[51] Int. Cl.[3] ..... B65D 43/14; B65D 51/04

[52] U.S. Cl. ..... 220/339; 150/55

[58] Field of Search ..... 220/334, 337, 339; 150/55; 16/225, DIG. 13

[56] References Cited

U.S. PATENT DOCUMENTS 3,933,296 1/1976 Ruskin et al. ..... 220/339

4,169,531 10/1979 Wood ..... 220/339

*Primary Examiner*—George T. Hall

*Attorney, Agent, or Firm*—Lee, Smith & Zickert

[57] ABSTRACT

A unitary container for playing or calling cards and the like. The container comprises a bottom part and a top part complementary to the bottom part, with the two parts, when engaged to constitute a closed container, forming an internal compartment. A flange extends about each of the top and bottom parts. These flanges are spaced apart by the sidewall which is a part of the bottom of the container. An exterior cap is provided for the top and bottom parts and secured to the flange thereabout. The top and bottom parts include respective first and second complementary closure elements which engage and lock when the container is closed.

9 Claims, 5 Drawing Figures

CONTAINER WITH INTEGRAL CLOSURE

BACKGROUND OF THE INVENTION

This invention relates to containers for flat articles such as playing and calling cards, and in particular to a unitary container which includes a unique closure for securing the top of the container to the bottom thereof.

Containers of the nature of the invention, which typically are made of thermo-formed plastic, include top and bottom parts which may be engaged as appropriate, and an integral living hinge between the top and bottom of the container. Normally, at least one edge of the top and the bottom includes a back draft so that the top and bottom may be fastened together when closed. The top and bottom parts of the container are provided with strengthening flanges which also aid in opening the container.

Normally the flanges butt one another when the container is closed. With the flanges thus engaged, it becomes quite difficult to grip them separately and open the container.

SUMMARY OF THE INVENTION

The invention is an improved container which includes, as primary components, a bottom and a top complementary to the bottom, with the top and bottom parts, when engaged to constitute a closed package, forming an internal compartment for one or more flat articles. A hinge connects the top and bottom parts along at one edge thereof.

The top includes a first closure element and the bottom includes a second closure element which is engageable with and complementary to the first closure element. The first closure element comprises a depending leg formed about the peripheral edge of the top of the container with the leg being directed slightly inwardly toward the compartment. The bottom includes an upstanding sidewall formed about the periphery thereof, and the second closure element comprises a recessed portion along the top of the sidewall forming a ledge along the bottom thereof against which the lower marginal edge of the top seats when the container is closed.

In the preferred embodiment of the invention, the sidewall of the bottom of the container includes an inner wall portion and an outer wall portion extending from and spaced from the inner wall portion, with the recess being formed in the outer wall portion. A first flange is formed about the outer wall of the container bottom and a second flange is formed about the depending leg, with the flanges being spaced from one another by the sidewall to form a gap which makes it easier to open the container.

Principally for appearance purposes, a cap is provided to cover each of the top and bottom of the container. Each cap is secured only to the flange about the part that it covers. Thus, each cap is spaced from the remainder of the container and contacts only the flange to which it is attached.

BRIEF DESCRIPTION OF THE DRAWINGS

The invention is described in greater detail in the following description of an example embodying the best mode of the invention, taken in conjunction with the drawings, in which.

DESCRIPTION OF EXAMPLE EMBODYING BEST MODE OF THE INVENTION

Figure 1:
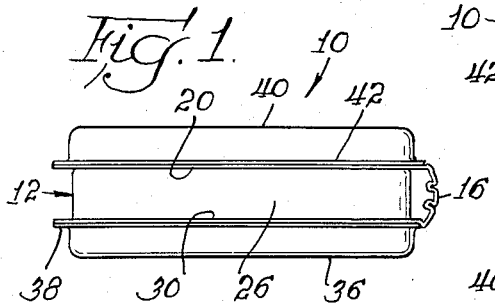
FIG. 1 is a side elevational illustration of a closed container according to the invention.

A case or container according to the invention is shown generally at 10 in the drawing figures. The container 10 is formed of plastic, such as p.v.c., polystyrene or PETG, by thermo-forming and includes a unitary bottom part 12, a unitary top part 14, and a hinge 16 connecting the bottom 12 to the top 14.

Figure 3:
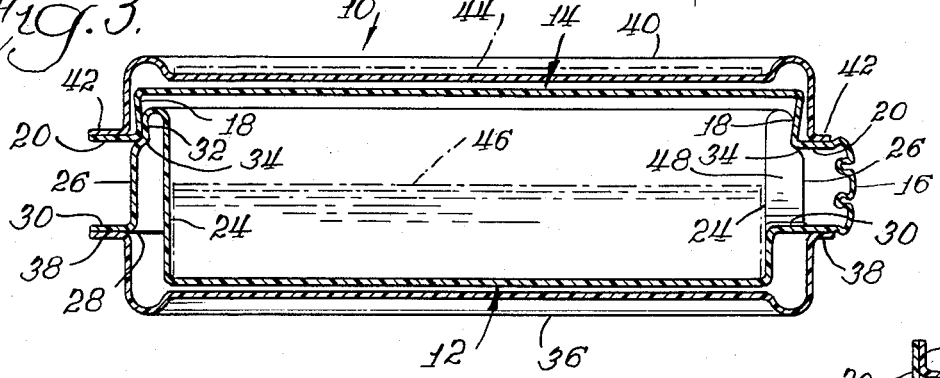
FIG. 3 is an enlarged cross-sectional view taken along line 3—3 of FIG. 2.
Figure 5:
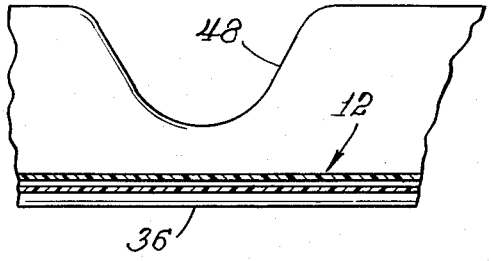
FIG. 5 is a fragmentary cross-sectional view taken along line 5—5 of FIG. 4.

As best shown in FIG. 3, the top 14 and bottom 12 are secured to one another when the container is closed. The top and bottom parts 14 and 12 each includes a complementary closure element which mutually engage when the container 10 is closed to form an internal compartment.

Figure 4:
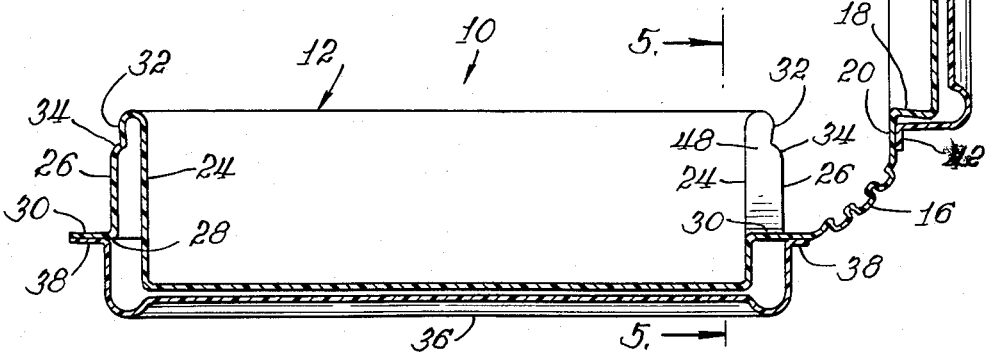
FIG. 4 is a cross-sectional view similar to FIG. 3, but with the container opened.
Figure 4:
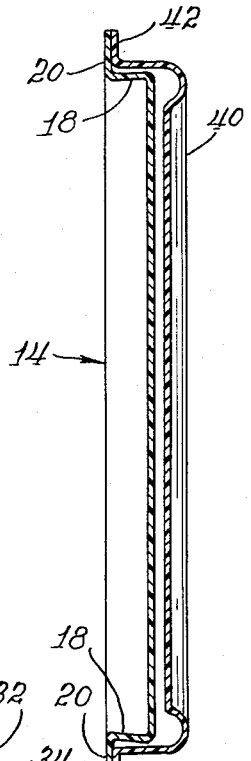

The top part 14 includes a depending leg 18 formed about the peripheral edge of the top with the leg 18 being directed slightly inwardly toward the interior compartment of the container 10, as when provided with a negative draft when the structure is thermoformed. A flange 20 extends outwardly from the leg 18 at the lower marginal edge thereof as best shown in FIGS. 3 and 4. With the leg 18 being directed slightly inwardly toward the interior compartment of the container 10, and with the leg extending about the entire periphery of the top 14, the lower marginal edge of the leg 18 from which the flange 20 extends provides a restricted entry into the top part 14 with peripheral dimensions somewhat less than those at the top of the top part 14 so that the container top can engage the bottom in a snap-lock fashion. The inwardly-directed leg 18 is formed with a back draft during the thermoforming of the container 10.

Figure 2:
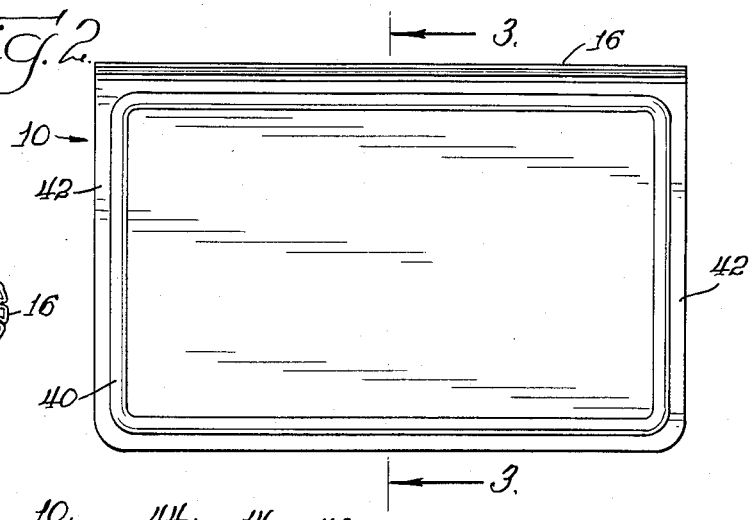
FIG. 2 is a top view of the container shown in FIG. 1.

The bottom of the container 12 includes an upstanding sidewall comprising an inner wall portion 24 and an outer wall portion 26, as shown. The outer wall portion 26 extends from and is spaced from the inner wall portion 24 and has a lower border 28 from which a flange 30 extends outwardly about the entire periphery of the bottom part 12. When the container 10 is closed, as shown in FIGS. 1–3 of the drawing, the peripheral flanges 20 and 30 are spaced from one another both to provide the desired depth of the space within the container and to greatly facilitate the opening of the container.

The outer wall portion 26 includes the portion of the closure for the container 10 which engages that of the top 14. The outer wall portion 26 includes a recess 32 along the top thereof which extends about the entire perimeter of the outer wall portion 26. The recess 32 also has a reverse draft and includes a ledge 34 at the base thereof against which the lower marginal edge of the leg 18 seats when the container 10 is closed. Thus, as shown in FIG. 3, the underside of the top of the top part 14 does not bear against any part of the bottom 12 in order to secure the container 10 in the closed orientation. Closure is effected by pressing the top onto the bottom of the container for snap interengagement of the leg 18 of the top part 14 with the recess 32 and ledge 34 of the outer wall portion 26 of the bottom 12.

In the preferred form of the invention, a cap 36 covers the bottom part 12 and is secured by a flange 38 to the flange 30. As shown, the cap 36 may be spaced from the bottom part 12, being secured thereto only by its flange 38 at the flange 30, or the spacing may be eliminated so that the cap 36 rests directly against the container bottom. In a similar fashion, a second cap 40 covers the top part 14 and is secured to the flange 20 by its flange 42. The caps 36 and 40 provide a finished look to the container 10 and also add additional strength to the broad, flat areas of the container, particularly if the container is thermo-formed from a relatively thin plastic material. The caps 36 and 40 can be adhesively secured to the container 10 or may be heat or electronically sealed thereto, as desired. In addition, either or both of the caps 36 and 40 may be recessed, as shown, to accommodate a label, business card, or other indicia, shown generally at 44 in phantom in FIG. 3, which may be used to identify the contents of the container or for other purposes. Alternatively, a card, label, etc. might be sandwiched between the cap 36 or 40 and associated bottom part 12 or top part 14 if the caps 36 and 40 are formed of plastic sufficiently transparent to permit reading of printing therethrough.

The contents of the container 10 are shown in phantom form at 46 and may comprise business cards, playing cards or other flat, thin articles which may be stacked in the interior of the container. To aid the user in removing a portion of the contents from the container 10, the sidewall includes a depression 48, at least as large as the typical user's finger, so that an edge of the contents 46 of the container can be easily engaged to permit their removal one-by-one or in groups.

The hinge 16 extends between the spaced flanges 20 and 30 as shown. The hinge 16 thus serves as a partial cover for the depression 48 so that, from the exterior, when the container 10 is closed, the contents cannot be seen. The placement and multiple character of the living hinge 16 along the spaced flanges 20 and 30 also permits the container 10 to be opened sufficiently so that the top 14 does not interfere with use of the depression 48, as shown in FIG. 4.

As shown in the drawing figures, the container 10 is a one piece structure which most economically is formed of a thin plastic material by a thermo-forming process. After the container 10 has been formed, the caps 36 and 40 are then secured to the respective flanges 30 and 20. While the caps 36 and 40 are auxiliary to the structure of the container 10 and may therefore be omitted, they provide an attractive, finished appearance to the container and, as explained above, also may be used to mount labels or other identification of the contents of the container 10.

Various changes may be made in the invention without departing from the spirit thereof or scope of the following claims.

What is claimed is:

1. A container comprising:

a. a unitary bottom part, b. a unitary top part complementary to said bottom part, c. said top and bottom parts, when engaged to constitute a closed container, forming an internal compartment, and d. a hinge connecting said top and bottom parts along one edge thereof, e. said top part including a first closure element and said bottom part including a second closure element engagable with and complementary to said first closure element, i. said first closure element comprising a depending leg formed about the peripheral edge of said top part, said leg being directed slightly inwardly toward said compartment and having a lower marginal edge, ii. said bottom part including an upstanding sidewall formed about the periphery of said bottom part, and said second closure element comprising a recess along the top of said sidewall, said recess being shaped to engage said leg in a snap-lock fashion and including a ledge against which said lower marginal edge of said leg seats when said container is closed.

2. A container according to claim 1 in which said sidewall comprises an inner wall portion and an outer wall portion extending from and spaced from said inner wall portion, said outer wall portion having a lower border, said recess being formed in said outer wall portion.

3. A container according to claim 2 including a first flange extending outwardly about said outer wall portion at said lower border and a second flange extending outwardly about said leg at said marginal edge, said flanges being spaced from one another forming a gap to assist opening of said container.

4. A container according to claim 1 in which said sidewall includes a first flange extending outwardly therefrom and said leg includes a second flange extending outwardly therefrom at said marginal edge, said flanges being spaced from one another forming a gap therebetween.

5. A container according to claim 4 including a cap for said top part secured to said second flange and a cap for said bottom part secured to said first flange.

6. A container according to claim 5 in which each said cap is spaced from the respective top or bottom part which is covered by said cap.

7. A container according to claim 4 in which said hinge is secured to said flanges and comprises a living hinge.

8. A container according to claim 1 including a depression in said sidewall to facilitate removal of any contents from said compartment.

9. A unitary container comprising a. a bottom part, b. a top part complementary to said bottom part, c. said top and bottom parts, when engaged to constitute a closed container, forming an internal compartment, d. said top part including a first closure element and said bottom part including a second closure element engagable with and complementary to said first closure element, i. said first closure element comprising a depending leg formed about the peripheral edge of said top part, said leg being directed slightly inwardly toward said compartment and having a lower marginal edge, ii. said bottom part including an upstanding sidewall formed about the periphery of said bottom part, and said second closure element comprising a recess at the top of said sidewall, said recess being shaped to engage said leg and including a ledge against which said lower marginal edge of said leg seats when said container is closed.

e. a first flange extending outwardly from said sidewall and a second flange extending outwardly from said leg at said marginal edge thereof, said flanges being spaced from one another forming a gap therebetween, f. a living hinge which is integral with and connects said top and bottom parts by means of said flanges, and an exterior cap for said bottom part secured to said first flange and an exterior cap for said top part secured to said second flange.

* * * * *